US005568719A

United States Patent [19]

Proctor

[11] Patent Number: 5,568,719

[45] Date of Patent: Oct. 29, 1996

[54] COMPOSITE YARN INCLUDING A STAPLE FIBER COVERING A FILAMENT YARN COMPONENT AND CONFINING THE FILAMENT YARN COMPONENT TO A SECOND THICKNESS THAT IS LESS THAN A FIRST THICKNESS OF THE FILAMENT IN A RELAXED STATE AND A PROCESS FOR PRODUCING THE SAME

[75] Inventor: Charles W. Proctor, Greensboro, N.C.

[73] Assignee: ProSpin Industries, Inc., Greensboro, N.C.

[21] Appl. No.: 354,279

[22] Filed: Dec. 12, 1994

Related U.S. Application Data

[63] Continuation-in-part of Ser. No. 896,819, Jun. 11, 1992, Pat. No. 5,383,331.

[51] Int. Cl.[6] ..... D02G 3/36; D02G 3/02

[52] U.S. Cl. ..... 57/225; 57/3; 57/12; 57/224; 57/226; 57/228; 57/285; 57/328

[58] Field of Search ..... 57/210, 225, 224, 57/285, 226, 228, 328, 3, 12

[56] References Cited

U.S. PATENT DOCUMENTS

| | | | |
|---|---|---|---|
| 3,342,028 | 9/1967 | Matsubayashi et al. | 57/163 |
| 3,343,356 | 9/1967 | McKinnon | 57/12 |
| 3,822,543 | 7/1974 | Edagawa et al. | 57/160 |
| 3,845,611 | 11/1974 | Senturk et al. | 57/5 |
| 3,940,917 | 3/1976 | Strachan | 57/152 |
| 4,069,659 | 1/1978 | Arai et al. | 57/160 |
| 4,296,597 | 10/1981 | Tani et al. | 57/205 |
| 4,489,540 | 12/1984 | Faure et al. | 57/5 |
| 4,497,167 | 2/1985 | Nakahara et al. | 57/328 |
| 4,614,081 | 9/1986 | Kim | 57/12 |
| 4,712,365 | 12/1987 | Ferrer | 57/12 |
| 4,757,680 | 7/1988 | Berger et al. | 57/328 |
| 4,866,924 | 9/1989 | Stahlecker | 57/243 |
| 4,921,756 | 5/1990 | Tolbert et al. | 428/373 |
| 4,928,464 | 5/1990 | Morrison | 57/224 |

FOREIGN PATENT DOCUMENTS

| | | |
|---|---|---|
| 35-049 | 4/1978 | Japan . |
| 53-122829 | 10/1978 | Japan . |
| 60-15729 | 4/1985 | Japan . |

*Primary Examiner*—William Stryjewski
*Attorney, Agent, or Firm*—Darby & Darby, P.C.

[57] ABSTRACT

A method for manufacturing a composite yarn of staple fibers and continuous multifilament yarn. The multifilament yarn is made from non-set, textured, no oil, polyester and first pretensioned before entering a spinning chamber where it is co-spun with the staple fibers which is made from pima cotton. The tension is relaxed after passing through the spinning chamber to allow the filaments of the yarn to expand and form a matrix to which the staple fibers can adhere. The expanded filaments cause the staple fibers to be tightly wound around the core. A composite yarn is also disclosed.

19 Claims, 5 Drawing Sheets

COMPOSITE YARN INCLUDING A STAPLE FIBER COVERING A FILAMENT YARN COMPONENT AND CONFINING THE FILAMENT YARN COMPONENT TO A SECOND THICKNESS THAT IS LESS THAN A FIRST THICKNESS OF THE FILAMENT IN A RELAXED STATE AND A PROCESS FOR PRODUCING THE SAME

This is a continuation-in-part of application Ser. No. 07/896,819, filed Jun. 11, 1992 now U.S. Pat. No. 5,383,331.

FIELD OF THE INVENTION

The present invention relates generally to yarns and processes for producing yarns and, more specifically, to a composite yarn and a process for producing a composite yarn comprising a multifilament yarn and staple fibers.

BACKGROUND OF THE INVENTION

The basic concept of spinning fibers is centuries old. Spinning staple fibers into useful threads and yarns improved their overall strength, to a limited extent, and allowed the final yarn to be spun with varying degrees of thickness, strength, etc.

With the advent of synthetic textile fibers, the possibility arose for producing continuous filament yarns with greater strength and more durability than those from staple fibers, and also no shrinkage. Accordingly, it has become possible to produce knitted and woven fabrics for apparel, home furnishing and industrial use. The shrinkage of these fabrics can be controlled by using a yarn where the heat annealing point of the polyester fiber which is spun into the continuous filament state has been exceeded. Products made from polyester yarn have excellent strength properties, dimensional stability and good color fastness to washing, dry cleaning and light exposure. The use of 100% polyester knit and woven fabrics became extremely popular during the late 1960's and through the 1970's. More recently, continuous filament polyester fiber has also been cut into staple where it can be spun into 100% polyester staple yarns or blended with cotton or other natural fibers. However, both 100% polyester and polyester blended yarns and fabric made from these yarns have a shiny and synthetic appearance, are clammy and prone to static conditions in low humidity, and tend to be hot and sticky in high humidity conditions. Additionally, polyester fiber, because of its high tensile strength, is prone to pilling in staple form and picking in continuous filament form.

Conventional methods of blending cotton and synthetics together have been less than fully successful as both mechanical and intermittent blends of polyester and cotton tend to pill, pick, shrink and are uncomfortable to wear. The consumer's use of polyester and polyester blended fabrics has been reduced over recent years in favor of 100% cotton fabrics which offer good appearance and comfort. This is especially true in the apparel industry. However, the use of 100% cotton yarn and fabrics also has its disadvantages. Primarily, fabrics made of 100% natural cotton tend to shrink and wrinkle. The most popular method of controlling cotton shrinkage for apparel outerwear is to coat the cotton fabric with resins made of formaldehyde. However, formaldehyde is considered to be a hazardous chemical and is therefore dangerous to handle during processing and is also considered dangerous on any fabrics that come into contact with the body because formaldehyde is a known carcinogen.

Additionally, formaldehyde-based resins, when used to control the shrinkage of cotton or cotton blend fabrics, degrade the abrasion resistant and strength properties of the fabric, thus making them more prone to fabric holes and scuffing.

The use of prewashing to control shrinkage is also less than satisfactory because it is wasteful in terms of the energy consumed and it also gives garments a worn appearance. Mechanical compaction has also been used to control the shrinkage of cotton fabrics. However, this process is expensive because of the high working loss and it is also not a permanent solution as compacted garments tend to return to their pre-compacted dimensions. For these reasons, the treating of cotton by resin is the currently preferred method to control the shrinkage of cotton fabrics. However, because most resins contain formaldehyde, the fabrics treated with resin are unsafe both during the manufacturing process and during their use by the consumer.

Accordingly, there is a need in the art to produce yarns that have both the positive qualifies of cotton fibers and synthetic filaments while eliminating their respective negative qualities. Composite yarns, per se, have been manufactured for many years. A well-known method of spinning both homogenous and composite yarns has been ring spinning, which has several advantages. For example, ring spinning produces a strong yarn of high quality, with a low capital investment per spindle. Unfortunately, ring spinning is a comparatively slow process, capable of producing only about 10 to 25 meters of yarn per minute, which greatly increases the cost of the final product. Still, since no other previously known process could produce the strength or feel of ring-spun yarn, this process is still used when the demand for its strength and feel justifies the high costs involved.

Other spinning machines and methods have been developed in more recent years in an attempt to produce a composite yarn with the quality of a ring-spun yarn. Some of these methods include open-end, vacuum, and air-jet spinning, which are capable of output capacities exceeding 10 to 25 times that of ring spinning. One such method is disclosed in U.S. Pat. No. 4,069,656 to Arai et al. Arai describes a process for producing yarns at high speed by feeding a bundle of short fibers along with fine multifilament yarn into a twisting device. The filament yarn is fed at sufficiently low tension and at a faster speed than the fibers such that the fine yarn becomes wrapped around the short fibers. Supposedly, the non-twisted configuration of the fiber bundle provides a good feel to the yarn.

However, the alternating twist of the yarn in this patent precludes its use as a sewing thread, where tear-resistance and high uniformity are required. Additionally, thread made from filament yarns such as that disclosed by Arai have smooth outer surfaces, which causes them to be easily pulled from seams. To date, high quality goods have consistently used mainly ring-spun staple fibers for thread, but as mentioned above, this greatly increases the costs.

Another attempt to create a high-quality composite yarn is disclosed in U.S. Pat. No. 4,866,924 to Stahlecker. A fiber component is first formed by a drawn sliver that is prestrengthened by false twist spinning. A filament yarn is then taken up with the fiber component onto a spool for subsequent spinning, using a conventional spinning method. According to the patent, when high demands are made on the composite yarn, such as are made on ring-spun staple fibers, it is necessary to rewind the yarn and clean it out so that defects, such as thick or thin points, can be removed. Obviously, the cost involved in rewinding the yarn, among other deficiencies, makes this yarn unacceptable as a viable, cost-effective alternative to ring-spun yarn.

U.S. Pat. No. 4,921,756 to Tolbert et al. discloses another attempt to create a high quality composite yarn. Core 11 is made from high temperature resistant continuous filament fiber glass and comprises about 20 to 40% of the total weight of the composite yarn. A sheath 12 of low temperature resistant staple fibers surrounds the core 11 and comprises from about 80 to 60% of the total weight of the composite yarn. A minor portion of the staple fibers 13 may be separated from the sheath 12 to form a binding wrapper spirally wrapped around the majority of the staple fibers. According to this patent, a glass-based core 11 is required to maintain the fire resistant property of the composite yarn.

In U.S. Pat. No. 4,928,464 of Morrison, a core filament yarn is tensioned and dragged over the sharp edge of a nonconductive material. After releasing the tension, a crimp develops on the filaments. The crimped filament yarn is then fed into a vacuum spinning device along with nipped sliver or roving. The crimp of the core filaments causes the individual filaments to repel each other and allows the sliver or roving to become partially intermixed with the core during spinning. When the core filaments enter the spinner, they are only tensioned sufficiently to carry them through the apparatus. In the final product, the fibers, while partially intermixed with the core, are relatively loosely spun around the core, allowing them to slide along it and expose the filament yarn beneath. This degrades the look and feel of any fabric produced with the yarn. This sliding phenomenon is known to occur with many existing composite yarns.

The vacuum spinning disclosed by Morrison is faster than conventional ring spinning, but is still considerably slower than air-jet spinning. In vacuum spinning, a shaft having multiple holes is rotated while suction is applied to the holes. This rotating shaft is capable of a rotational speed much less than that caused by air jets. An effective air-jet spinner is disclosed in U.S. Pat. No. 4,497,167 to Nakahara et al. The dual-nozzle system provides high-speed, uniform spinning. The only necessary tension on the entering fibers is that sufficient to carry the fibers through the nozzles.

The type of air-jet spinner disclosed by Nakahara can also be applied to composite spinners, such as the "High-Speed Type Murata Jet Spinner," manufactured by Murata Machinery, Ltd., Kyoto, Japan. This machine is capable of producing 300 meters per minute, while maintaining uniform spinning. Nevertheless, with any of the known air-jet spinners, it has been impossible to achieve a tight enough wrapping of fibers around a core to prevent any slippage or pilling.

SUMMARY OF THE INVENTION

The present invention is directed to a method for manufacturing yarn of staple fibers and continuous multifilament yarn. The multifilament yarn is first heavily pretensioned before entering a spinning chamber where it is co-spun with the staple fibers. The tension is relaxed after passing through the spinning chamber to allow the filaments of the yarn to expand and form a matrix to which the staple fibers can adhere. The expanded filaments cause the staple fibers to be tightly wound around and anchored to the core, preventing any slippage or excess pillage and providing for superior "feel" by preventing the core filaments from being exposed.

To the contrary, it has been the practice in the prior art to feed the multifilament yarn at little or no tension in order to improve intermixing with the staple fibers. However, it was surprisingly discovered that pretensioning the textured yarn sufficiently to temporarily remove any crimp prior to spinning dramatically increases the quality and durability of the composite yarn produced.

During spinning, the sliver may be applied with an opposite spin direction to that of the continuous multifilament yarn to create a more balanced yarn. Materials knit from the resulting yarn have high ball burst strength, low random pill test results, and low shrinkage (on the order of 2–3%).

Accordingly, one aspect of the present invention is to provide a two-component composite yarn, including a staple fiber component and a filament yarn component that is tensioned before being spun.

Another aspect of the present invention is to provide a method of co-spinning a continuous filament yarn and staple fibers in a spinner to produce a two-component composite yarn. The method includes the steps of feeding a sliver or roving of the staple fibers through a drafting apparatus to prepare a continuous bundle; pretensioning the filament yarn; combining the continuous bundle of fibers and the filament yarn downstream of said drafting apparatus; and feeding them into a spinner.

Still another aspect of the present invention is to provide a yarn produced according to the above method.

These and other aspects of the present invention will become apparent to those skilled in the art after a reading of the following detailed description of the preferred embodiment in conjunction with a review of the appended drawings.

DETAILED DESCRIPTION OF THE PREFERRED EMBODIMENTS

In the following description, it is to be understood that such terms as "forward", "rearward", "left", "right", and the like are words of convenience and are not to be construed as limiting terms.

Figure 1:
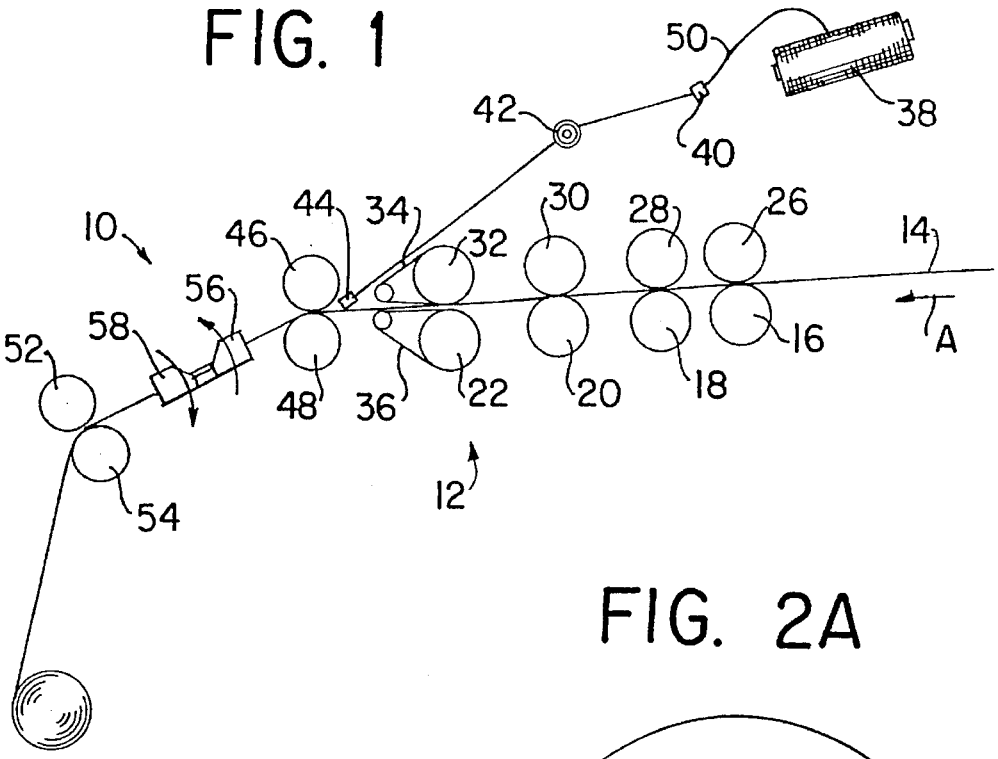
FIG. 1 is a schematic representation of a yarn spinning apparatus constructed according to the present invention.

Now referring to the drawings, as best seen in FIG. 1, there is shown a schematic representation of a yarn spinning apparatus, generally designated 10, constructed according to the present invention.

Spinning apparatus 10 includes a drafting frame 12 to which a staple sliver 14 is fed in the direction of arrow "A". In the drafting frame 12, a staple sliver 14, such as from cotton, is drawn to the desired size, as is known in the art. The drafting frame 12 preferably has bottom rollers 16,18, 20,22 and top pressure rollers 26,28,30,32. Top and bottom aprons 34,36 are driven by rollers 32,22, respectively, also as is known. The resulting staple fibers 14 are prepared to be spun. In a preferred embodiment, the staple sliver 14 is a cotton fiber made from pima cotton because, in general, pima cotton is stronger than most other cottons. The use of pima cotton is preferred because of its relatively long staple fibers which average in length from 1.375 inches to 1.5 inches.

A stretch textured multifilament "reverse" S-twist (clockwise twist) yarn 50, such as a stretch "S"-twist 70 denier/34 filament yarn, is withdrawn from yarn supply 38 through guide 40, pretensioning device 42 and ceramic thread guide 44 located downstream of the aprons and before top and bottom nip rollers 46,48. The pretensioning device 42 is preferably an adjustable spring-loaded cymbal tension device that the multifilament yarn 50 is passed through so that the yarn can be adjusted to provide the best results. Other known tensioning devices may be employed.

Figure 2A:
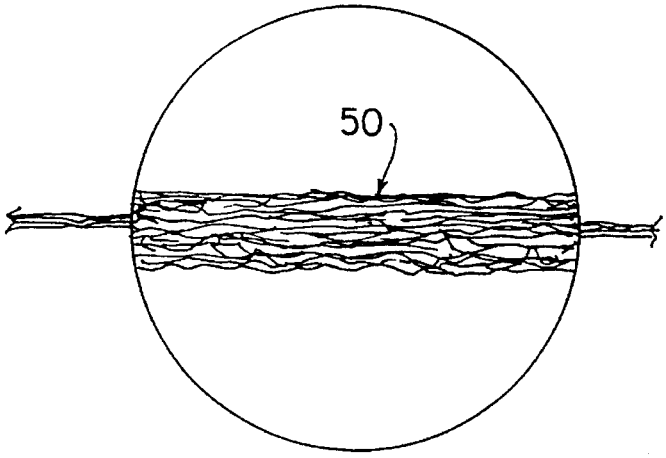
FIGS. 2A–2D are partially magnified schematic views of a yarn at various stages of production according to the present invention.

As seen in FIG. 2A, when the stretch textured "S" twist multifilament yarn 50 is removed from its supply, it is in a crimped state with inter-filament gaps caused by the random abutment of adjacent crimps. The gaps also cause the yarn 50 to have an overall average thickness in its relaxed state substantially exceeding the average thickness in its tensioned state. While only a small number of filaments are shown in FIGS. 2A–2D, it is to be understood that the preferred multifilament yarn is comprised of as many filaments as are necessary to produce the desired final composite yarn.

Figure 2B:
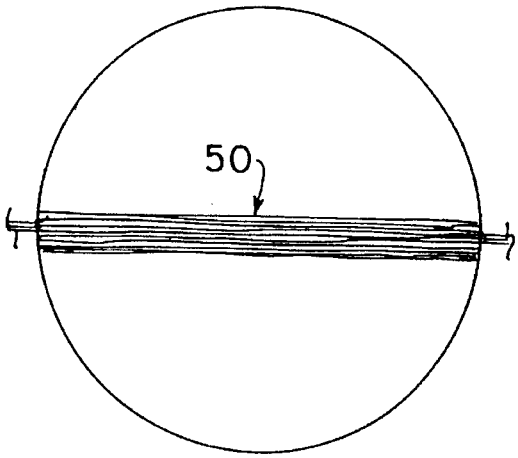

The yarn filaments shown in FIG. 2A exit in that crimped, expanded state from the yarn supply 38 to the pretensioning device 42. After the pretensioning device, the multifilament yarn is pulled sufficiently taut such that the crimp is temporarily substantially removed from the filaments, as seen in FIG. 2B. The multifilament yarn 50 is preferably a synthetic material, such as polyester, nylon, rayon, acrylic, polypropylene, spandex, acetate, asbestos, glass filament, polyolefin, carbon fiber, or quartz multifilament yarn. As seen in FIG. 2B, the overall average thickness has been significantly reduced by tensioning yarn 50 and temporarily removing the crimp.

The multifilament yarn 50 then enters between the top and bottom nip rollers 46,48, which maintain the tension on the yarn 50. The tension is similarly maintained between the first nip rollers 46,48 and second nip rollers 52,54.

Figure 2C:
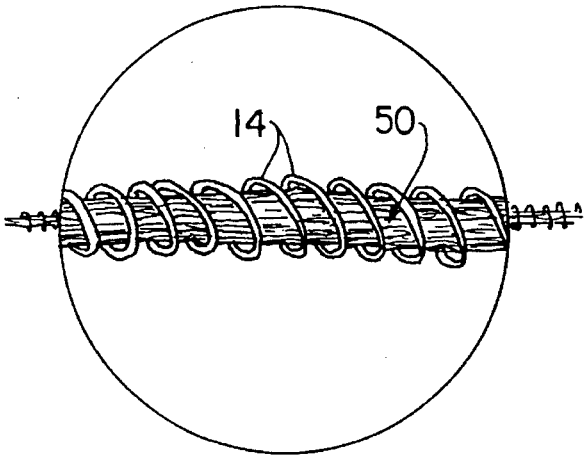
Figure 2D:
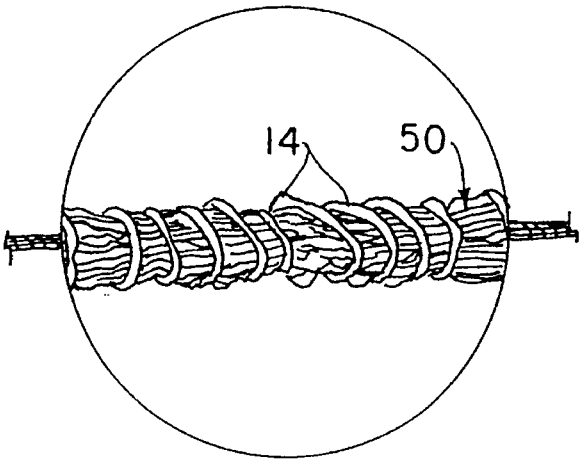
Figure 3:
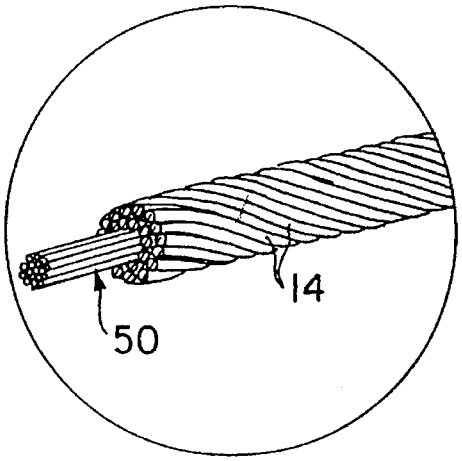
FIG. 3 is a magnified perspective of an end of a completed composite yarn according to the present invention.

At the first nip rollers, the yarn 50 and the staple fibers 14 are combined and fed into the air-jet zone. The air-jet zone is preferably constructed as shown in U.S. Pat. No. 4,497,167. The cotton staple sliver 14 and the core filament yarn 50 enter the first air jet 56 where the loose cotton staple is wrapped around the core yarn 50 with a clockwise rotation, as seen in FIG. 2C. It is to be understood that the cotton staple fibers completely surround the core yarn 50 and that the illustrated single spread-out winding 14 in FIG. 2C, is shown exaggerated, for illustration purposes. Thus, the wrapped staple fibers 14 are shown spaced in order to show the condition of the underlying core. Similar false spacing is shown in FIG. 2D. Preferred covering by the cotton fibers 14 of the core yarn 50 is shown in FIG. 3.

After leaving the first air-jet 56, the combined filament and staple fibers then pass into the second air jet 58 where the combined yarn is subsequently twisted with a counterclockwise rotation. Since in this case, the core filament yarn was processed with a "S" twist (clockwise twist), the core's rotational orientation is opposite the "Z" twist (counterclockwise twist) orientation of the composite yarn, which leads to a stable "balanced" final yarn with reduced twist. The direction of the two air jets 56,58 can be reversed if the core yarn has been processed with a "Z" twist (counterclockwise twist). The core twist can also be matched to the composite yarn twist to produce a covered yarn with increased twist.

Upon leaving the second air jet 58, the combined yarn passes through second nip rollers 52,54, with the core still under tension and looking much like FIG. 2C. Although exaggerated, the space between the loops of the surrounding staple fibers and the core illustrates how easily the fibers 14 might move along the core 50 if the yarn were completed at this point.

After the second nip rollers 52,54, the core 50 is finally released from its tension, causing it to expand to a state similar to FIG. 2A. However, it is now wrapped with and constrained by the surrounding staple fibers 14, which bind the core and prevent it from reaching its fully expanded state and thus, simultaneously become more taut themselves. This tight wrapping, unattainable through conventional spinning alone, increases the frictional engagement between the staple fibers 14 and the core 50, greatly reducing slippage. The core filaments also tend to enter, but not penetrate, between the surrounding fibers, further increasing the anchoring of the outer fiber cover to the inner core. It will be understood that the final overall thickness of the core 50 after expanding is still less than the original thickness, since it is constrained by the staple fibers.

In a preferred embodiment, the multifilament yarn 50 is a polyester yarn which is not set. In other words, the polyester yarn is what is conventionally known as a partially oriented yarn (i.e., the yarn is not fully drawn). Normally, a polyester yarn is put through a preheating step by the manufacturer. However, by bypassing the final heating step, the yarn is not set and is able to stretch by 20% to 25%. The non-set yarn is textured (i.e., somewhat crimped) such that the yarn can be elongated beyond just the amount required to take up and straighten out the crimp where the yarn has a first predetermined thickness and is in a relaxed state, but the yarn can also be stretched such that its thickness is reduced. It is preferred that the multifilament core be stretched to this point beyond where the crimp has been taken out such that the polyester non-set yarn is stretched to a second predetermined reduced thickness, which is smaller than the first predetermined thickness of the yarn in a relaxed state. It is preferred that while the polyester non-set yarn is in the stretched condition, the pima cotton is combined with the non-set polyester yarn by spinning with airjets 56, 58. After the spinning process, the tension applied to the multifilament 50 is released, causing the core 50 to expand. However, the core 50 is now wrapped with and constrained by the surrounding staple cotton pima fibers 14. Fibers 14 bind the core and prevent it from reaching its fully expanded state. The total size of the composite yarn is preferably within the range of about 80/1 to 6/1 conventional cotton count.

Figure 9:
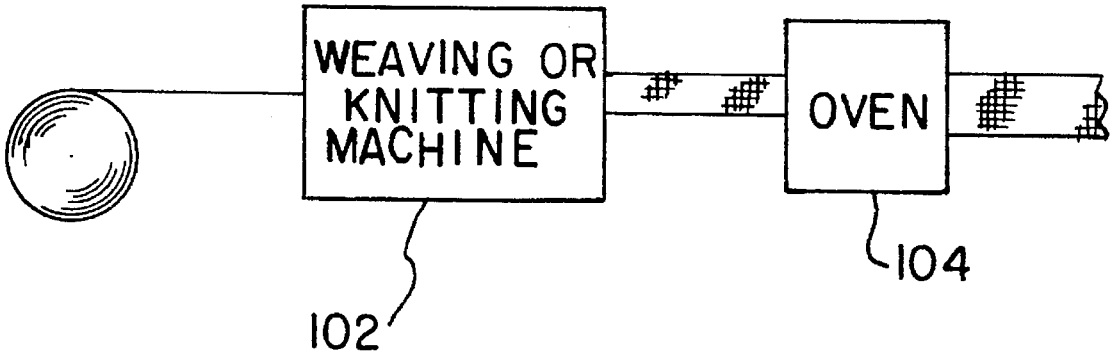
FIG. 9 shows the weaving or knitting and stentering equipment.

The percentage of staple fiber to filament yarn (by weight) is preferably controlled such that the cotton cover fiber can not be readily stripped off during further processing of the yarn into fabric. Additionally, the cotton cover should not be too thick, otherwise the cotton cover could more readily be stripped off even after the fabric has been woven. Accordingly, Applicants have discovered that it is preferable that the cotton cover comprise more than 30% and less than 70% of the overall composite yarn by weight. After the composite yarn has been woven or knitted into a fabric, and after dying, the last processing step is stentering in a continuous oven at a temperature of 390 to 410 degrees fahrenheit to set the polyester thermoplastic core (see FIG. 9). Once the core is heat set in this manner, the fabric can undergo repeated washings in hot water and drying in a hot dryer and the fabric will retain its shape and size because the fabric will not again be subjected to temperatures exceeding 390 to 410 degrees F. It is also preferred that the core material be a thermoplastic material. Accordingly, the core can not be made from a nylon or glass material because these materials are not thermoplastic, which is required for this process. Fabric made (i.e., knitted or woven) from the composite yarn according to the present invention has significantly less shrinkage than conventional cotton fabrics which have been shrinkage controlled by conventional methods, such as application of formaldehyde-based resins, pre-shrinkage or compaction. Additionally, fabrics made according to the present invention may be dyed and/or printed with conventional methods because the outer surface of the composite yarn is completely made of cotton. Thus, fabrics made in accordance with the present invention are especially suitable for forming knit and woven, shrinkage resistant fabrics for use in apparel, industrial and home furnishing industries.

The preferred core yarn is a multi-filament, textured, stretched, (non-set) yarn with a twist opposite to that of the air jet spinning process. The core yarn should consist of a denier that is between 30% and 70% of the overall composite yarn by weight. The preferred staple fiber is a cotton fiber made from pima cotton.

The process and products according to the present invention will become more apparent upon reviewing the following detailed examples:

EXAMPLE 1

Figure 4:
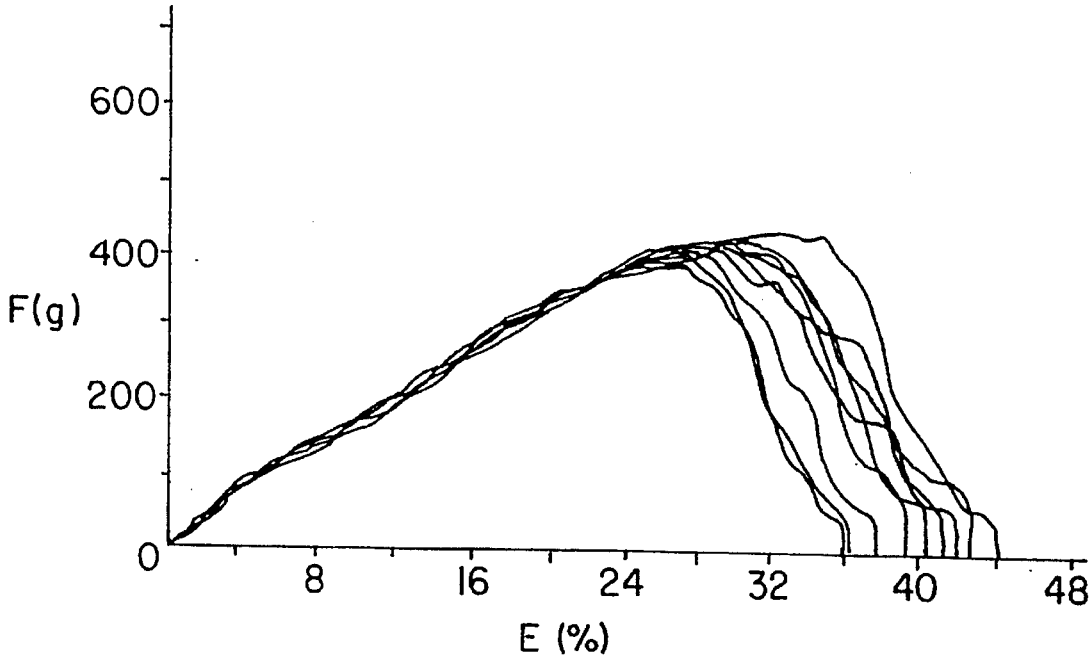
FIGS. 4–8 show graphical representations of the force elongation curves for various example yarns described below.

10 samples of 70 denier 34 filament stretch textured multifilament yarn were tested on a Uster TENSORAPID testing machine. Results of the tests are shown in FIG. 4 and in Table 1 below. As can be seen, the yarn is a relatively high-strength high-elongation yarn with little variation in elongation or B-force (breaking force). The curve shown in FIG. 4 is typical of what would be expected for modem man-made multifilament yarns.

TABLE 1

| | X | V |
|---|---|---|
| Elongation | 29.23% | 7.36 |
| B-Force | 414.10 g | 2.91 |
| Tenacity | 53.31 RKM | 2.91 |
| Work to Rupture | 3499.60 g*cm | 12.89 |

where X is the mean, V is the coefficient of variation, RKM represents grams per Tex (1000 meters), and g*cm represents grams per 100 meters.

EXAMPLE 2

Figure 5:
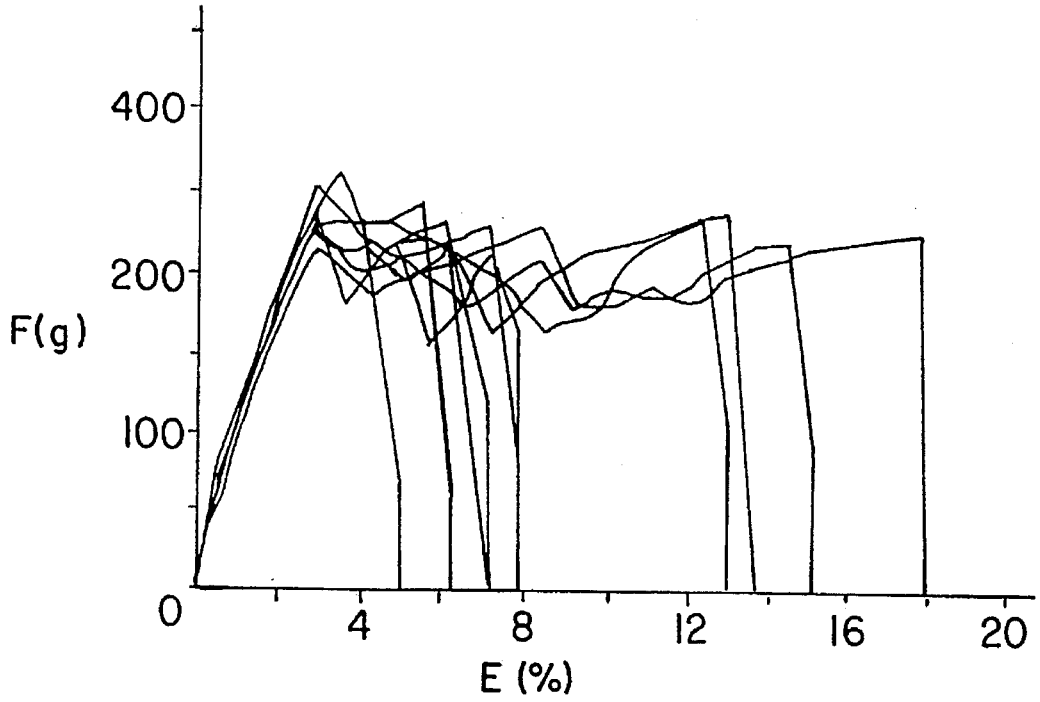

10 samples of a 70 d/34 stretch texture yarn and stable fiber composite yarn were tested on an Uster testing machine. The stretch textured filament yarn was pretensioned at 20 gms. Results of the tests are shown in FIG. 5 and in Table 2 below. As can be seen, the yarn is a relatively low-strength, low-elongation yarn with an undesirable large variation in elongation. The curve shown in FIG. 5 is typical of what would be expected for an incompletely intermixed composite yarn.

TABLE 2

| | X | V |
|---|---|---|
| Elongation | 4.38% | 69.80 |
| B-Force | 240.90 g | 5.43 |
| Tenacity | 7.34 RKM | 5.43 |
| Work to Rupture | 364.74 g*cm | 90.21 |

EXAMPLE 3

Figure 6:
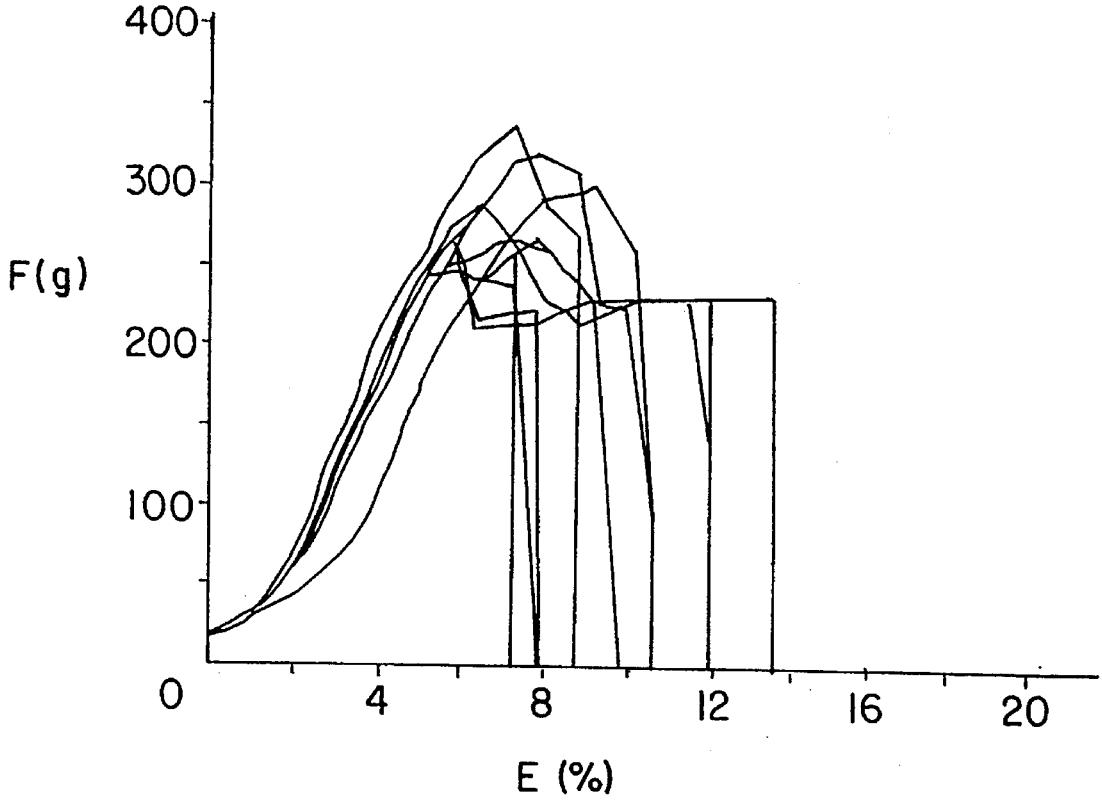

10 samples of a 70 d/34 filament stretch textured yarn and stable fiber composite yarn were tested similarly as above. The filament yarn was pretensioned at 50 gms. Results of the tests are shown in FIG. 6 and in Table 3 below. As can be seen, this yarn also is a low-strength, low-elongation yarn with a large variation in elongation between individual fibers. The curve in FIG. 6 is also typical of what would be expected for an incompletely intermixed composite yarn. However, the "knee" of the curve at about 6% elongation and the lower range of variation in elongation compared to Example 2 indicates that increasing the tension improves the quality of the yarn.

TABLE 3

| | X | V |
|---|---|---|
| Elongation | 6.78% | 15.63 |
| B-Force | 290.66 g | 9.66 |
| Tenacity | 8.86 RKM | 9.66 |
| Work to Rupture | 529.19 g*cm | 23.31 |

EXAMPLE 4

Figure 7:
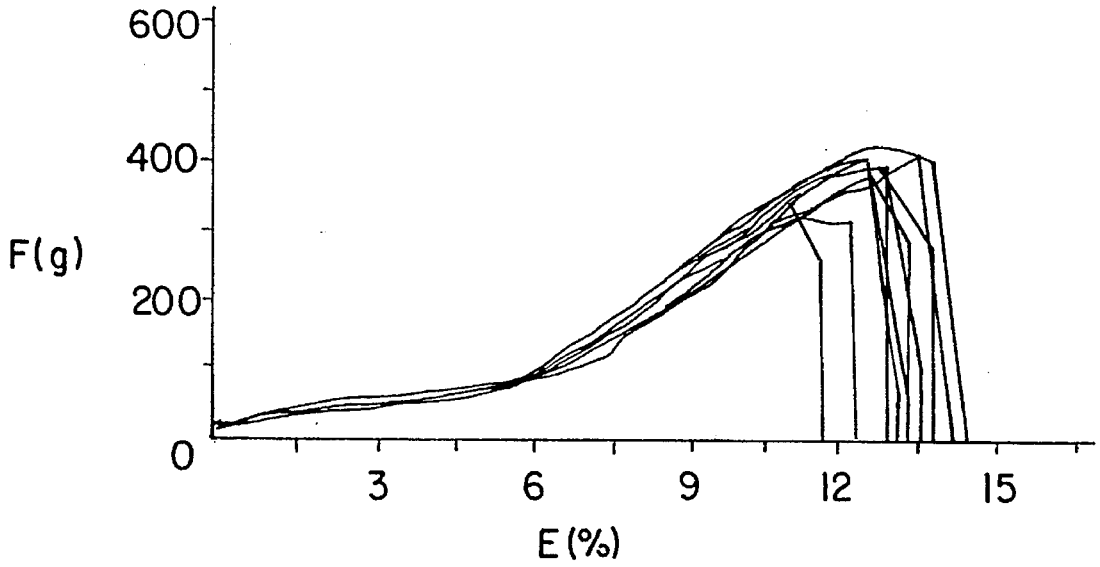

10 samples of a 70 d/34 filament stretch textured filament yarn and staple fiber composite yarn were tested as above. The filament yarn was pretensioned at 75 gms. Results of the tests are shown in FIG. 7 and in Table 4 below. As can be seen, this composite yarn is a higher-strength, higher-elongation yarn with a smaller range of variation in elongation than any of the previous examples. The curve is as expected for a substantially completely intermixed composite yarn. Note the well defined "knee."

TABLE 4

| | X | V |
|---|---|---|
| Elongation | 12.61% | 5.77 |
| B-Force | 370.91 g | 7.73 |
| Tenacity | 11.31 RKM | 7.73 |
| Work to Rupture | 984.71 g*cm | 14.06 |

EXAMPLE 5

Figure 8:
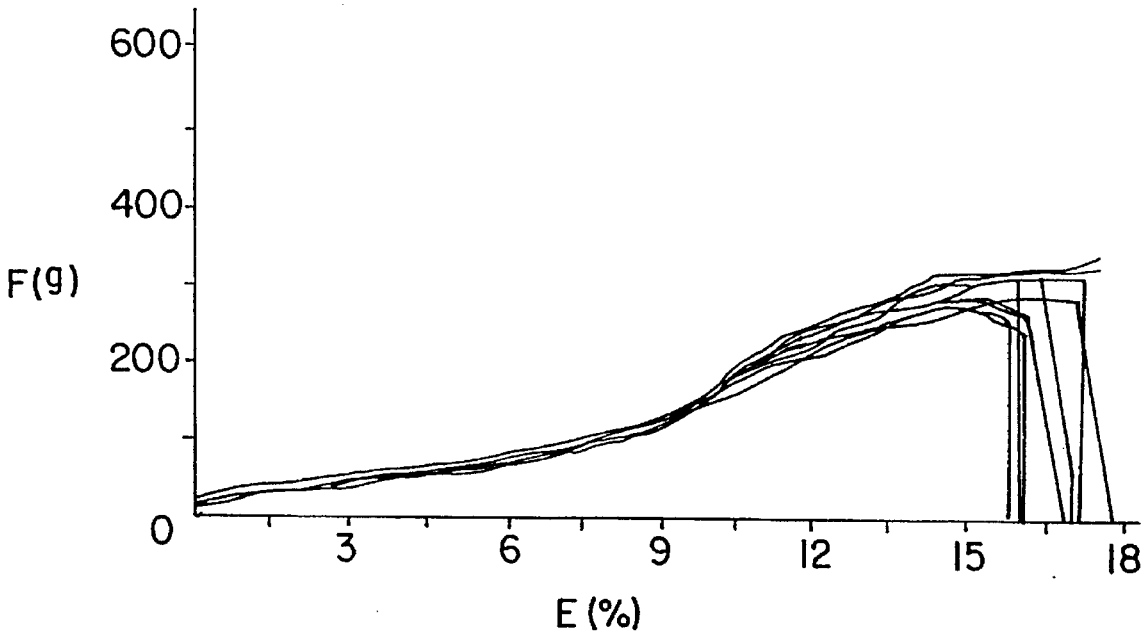

10 samples of a 70 d/34 filament stretch textured yarn and staple fiber composite yarn were tested as above. The filament yarn was pretensioned at 150 gms. Results of the tests are shown in FIG. 8 and in Table 5 below. As can be seen, this yarn is also a higher-strength, higher-elongation yarn with a small variation in elongation. The curve shown in FIG. 8 is typical of what would be expected for an intermixed composite yarn. Note the well defined "knee." However, the Tenacity value is slightly lower than for Example 4 indicating additional pretensioning would not produce a better quality yarn.

TABLE 5

| | X | V |
|---|---|---|
| Elongation | 16.21% | 6.37 |
| B-Force | 301.36 g | 8.47 |
| Tenacity | 9.19 RKM | 8.47 |
| Work to Rupture | 1147.74 g*cm | 17.82 |

EXAMPLE 6

150 d/34 filament stretch textured yarn was evaluated for testing as above. While not actually tested, it is expected that if tested the results of the tests would be as shown in Table 6 below. Elongation and tenacity are material dependent properties and are expected not to change with denier. However, B-force, which is dependent on denier, is expected to about double.

TABLE 6

| | X | V |
|---|---|---|
| Elongation | 29.23% | 7.36 |
| B-Force | 818.40 g | 2.91 |
| Tenacity | 53.31 RKM | 2.91 |

EXAMPLE 7

150 d/34 filament stretch textured yarn and staple fiber composite yarn were evaluated for testing as above. If it is assumed that the filament yarn was pretensioned at 150 gms, the results shown in Table 7 below are anticipated to closely follow the results of the 70 d filament yarn pretensioned at 75 gms (see Table 4 for comparison). Elongation and tenacity are material dependent properties and are expected not to change with denier. However, B-force, which is dependent on denier, is expected to about double when comparing 70 denier to 150 denier.

TABLE 7

| | X | V |
|---|---|---|
| Elongation | 12.61% | 5.77 |
| B-Force | 741.82 g | 7.73 |
| Tenacity | 11.31 RKM | 7.73 |

It is to be understood that in place of the cotton staple fibers, similar staple fibers such as rayon, polypropylene, acetate, asbestos, nylon, polyester, acrylic, wool, cashmere, alpaca, mohair, linen, silk and polyolefin could be substituted.

EXAMPLE 8

Thermo-plastic continuous filament, no oil, polyester 50 having a weight necessary to achieve approximately 50% of the overall yarn weight was set between the front rollers 46, 48 as illustrated in FIG. 1. At the same time, a sliver of cotton staple fibers, having a weight necessary to achieve approximately 50% of the overall yarn weight, was fed through bottom rollers 16, 26; 18, 28; 20, 30 and concurrently through front nip rollers 46, 48 with the continuous filament, thermo-plastic polyester yarn. The cotton sliver has a weight of 30 gms/yd, and the polyester core is 70 denier. The non-lively free core spun or composite yarn achieved by this air jet spinning process has a 38/1 conventional cotton count and was knitted on a 24 cut interlock machine to form a knitted interlock fabric having a yield of approximately 5.2 oz/square yard.

To point out the significant performance differences between the nonhazardous shrinkage resistant balanced cotton/thermo-plastic core spun yarn and interlock knitted fabric made thereof, a conventional ring spun 100% cotton yarn in cotton count 38/1 was knitted on the same knitting machine with the same finished yield of 5.1 oz/square yard. Both fabrics were jet dyed color white, extracted, slit open width, and stentered at a temperature of approximately 390° F.

RANDOM PILL TEST

The fabrics were tested for pilling using ANSI/ASTM D 3512-76 using an Atlas Random Pilling Tester where the interpretation of the results is graded on a scale of 1–5; 1 is very severe pilling, 2 is severe pilling, 3 is moderate pilling, 4 is slight pilling, and 5 is no pilling, with half values being assigned when the appearance falls between two rating standards. Results are as follows:

| | 30 Minute Test | 60 Minute Test | 120 Minute Test |
|---|---|---|---|
| A. 100% Cotton | 3.0 | 3.0 | 3.5 |
| B. Composite Yarn | 4.0 | 4.5 | 4.5 |

Using the same interlock knit fabric made from 38/1 yarn count 100% cotton, a new dye lot was prepared identically by jet dyeing, extraction, slit open, then padding approximately a 300 ppm formaldehyde resin for shrinkage before stentering at 390° F.

FABRIC BURSTING STRENGTH (P.S.I.)

All three fabrics were then tested for bursting strength in lbs/square inch using test method ASTM D 3786-87 Hydraulic Diaphragm Bursting Test.

| | Pounds To Burst |
|---|---|
| A. 100% Cotton Fabric (With 300 ppm Resin) | 60 |
| B. 100% Cotton Fabric (No Resin) | 100 |
| C. Composite Yarn | 160 |

DIMENSIONAL CHANGE (MAX. %)

Fabrics were also tested for dimensional change in percent length x width using test method AATCC 135-1987 [(1) IVA(ii)] 3 launderings.

| | |
|---|---|
| A. 100% Cotton Fabric (With 300 ppm Resin) | 7% W × 10% L |
| B. 100% Cotton Fabric (No Resin) | 12% W × 17% L |
| C. Composite Yarn Fabric | 3% W × 3% L |

COEFFICIENT OF VARIATION

Again using the same 38/1 100% cotton and 38/1 core spun yarn, an evenness test was conducted using a Uster Evenness Tester Model UT3 which gives the evenness of the yarn in the coefficient of variation where the mean deviation is divided by the standard deviation and multiplied by 100. Results are as follows:

| | CV % | Thin | Thick | Neps |
|---|---|---|---|---|
| A. 100% Cotton | 16.17 | 91 | 249 | 17 |
| B. Composite Yarn | 10.79 | 0 | 13 | 3 |

SINGLE END BREAKS

Again using the same 389/1 100% cotton and 38/1 core spun yarn, a test for strength was conducted using the Uster Single Break Machine.

| | B-Work | B-Strength | Tenacity (GF/Tex) |
|---|---|---|---|
| A. 100% Cotton | 200.4 | 230.8 | 14.85 |
| B. Composite Yarn | 1753.0 | 353.3 | 19.15 |

ELONGATION

And finally, again using the same 38/1 100% cotton and 38/1 core spun yarn, a test for elongation was conducted using the Lawson Hemphill Statimat. The figures are as follows:

| | Elongation |
|---|---|
| A. 100% Cotton | 3.31 |
| B. Composite Yarn | 16.50 |

Fabric Advantages

Fabrics produced with yarns according to the present invention display several advantages with respect to other fabrics, such as 100% cotton and conventional poly/cotton blends. These advantages include less pilling and higher ball burst strength. The fabrics also have high uniformity and even cover, due to the reduced slippage of the cover staple fibers and the evenness of the filament core yarn.

In the embodiment of the yarn in which the core has the reverse twist of the cover fibers, there is less fabric biasing. This reduces the tendency of hems or other garment parts to torque or bias. The fabrics produced with yarns according to the invention also exhibit lower shrinkage, i.e., less than 2–3%, compared to typical cotton fabric, which exhibits 12–14% shrinkage. Therefore, there are lower finishing costs, since no formaldehyde-based resin is necessary to decrease the shrinkage as with the cotton fabric.

Therefore, the composite yarns of the present invention and fabrics produced with them exhibit the positive qualities of filament yarns and staple fibers, while avoiding the negative qualities of both.

It is to be understood that while the embodiments shown and described are fully capable of achieving the above objects and advantages, these embodiments are shown and described only for the purpose of illustration and not for the purpose of limitation.

What is claimed is:

1. A composite yarn, comprising:

a staple fiber made from pima cotton, said staple fiber component formed by drafted sliver;

a filament yarn made from non-set, textured, polyester, said filament yarn component formed by applying tension to a filament yarn initially having a crimp such that said crimp is temporarily substantially removed, said filament yarn having a first predetermined thickness in a relaxed state, wherein said staple fiber component and said pretensioned filament yarn component are combined by spinning while said tension is applied to said filament yarn to stretch said filament yarn to a second thickness that is less than said first thickness, said staple fiber substantially covers the filament yarn component and confines the filament yarn component to said second thickness, said filament yarn is a stretch textured multifilament yarn.

2. The composite yarn according to claim 1, wherein the ratio of said filament yarn to said staple fiber is between 30/70 and 70/30.

3. The composite yarn according to claim 1, wherein said filament yarn is between 70 and 150 denier.

4. The composite yarn according to claim 1, wherein the pretensioning of said filament yarn is between one and two grams per denier.

5. The composite yarn according to claim 4, wherein the pretensioning of said filament yarn is one gram per denier.

6. The composite yarn according to claim 1, wherein said pretensioning is of sufficient strength to stretch said filament yarn by 20–25%.

7. A composite yarn, comprising:

a core of multifilament yarn made from non-set, textured, polyester, said multifilament yarn having a crimp and a first predetermined thickness in a relaxed state; and a sheath of staple fibers made from pima cotton substantially covering said core, said sheath confining said core to a second thickness less than said first thickness.

8. A method of co-spinning a continuous stretch textured filament yarn and staple fibers in a spinner to produce a composite yarn, said method comprising the steps of:

feeding a sliver or roving of said staple fibers through a drafting apparatus to prepare a continuous bundle of staple fibers;

pretensioning said filament yarn to stretch said filament yarn to a second thickness that is less than a first thickness of said filament yarn in a relaxed state such that said texture is temporarily substantially removed;

combining said continuous bundle of staple fibers and said filament yarn downstream of said drafting apparatus;

feeding said combined continuous bundle and said filament yarn into said spinner; and releasing said filament yarn from tension such that said bundle of staple fibers substantially covers the filament yarn and confines the filament yarn to said second thickness.

9. A method according to claim 8, wherein said spinner is an air jet spinner.

10. A method according to claim 8, wherein said staple fibers are made from pima cotton.

11. A method according to claim 10, wherein said filament yarn is made from non-set, textured, polyester.

12. A composite yarn, comprising:

a staple fiber cover strand made from pima cotton and a multiple filament core component made from non-set, textured, polyester, said multiple filament core component having a first predetermined thickness in a relaxed state, said fiber cover strand being circumferentially wound around and substantially covering said core component while a tension is applied to said multiple filament core component to stretch said multiple filament core component and said multiple filaments of said core being expanded, when said tension is released, outwardly into friction locking engagement with said circumferentially wound fiber cover strand whereby the multiple filament core component is confined to a second thickness that is less than the first thickness.

13. A composite yarn as in claim 12, wherein said multiple filament core is of such structure that, in a contracted condition thereof, it exhibits an outside diameter substantially smaller than the diameter thereof in said expanded friction locking condition thereof.

14. A composite yarn as in claim 12, wherein said multiple filament core is in said contracted condition when said fiber cover strand is wound thereabout and is adapted to expand into said expanded locking friction condition thereof after said fiber core strand has been wound thereabout.

15. A method of producing and treating a fabric by co-spinning a continuous stretch textured filament yarn and staple fibers in a spinner to produce a composite yarn, said method comprising the steps of:

feeding a sliver or roving of said staple fibers through a drafting apparatus to prepare a continuous bundle of staple fibers;

pretensioning said filament yarn to stretch said filament yarn to a second thickness that is less than a first thickness of said filament yarn in a relaxed state such that said texture is temporarily substantially removed;

combining said continuous bundle of staple fibers and said filament yarn downstream of said drafting apparatus;

feeding said combined continuous bundle and said filament yarn into said spinner;

releasing said filament yarn from tension such that said bundle of staple fibers substantially covers the filament yarn and confines the filament yarn to said second thickness; and weaving or knitting the combined filament yarn and staple fibers into a fabric and thereafter stentering said fabric in an oven.

16. A method according to claim 15, wherein said stentering step is carried out at a temperature range of 390°–410° F.

17. A method according to claim 15, wherein said staple fibers are made from pima cotton.

18. A method according to claim 17, wherein said filament yarn is made from non-set, textured, polyester.

19. A method according to claim 15, wherein said spinner is an air jet spinner.

* * * * *